US005292017A

United States Patent [19]

Reifers

[11] Patent Number: 5,292,017

[45] Date of Patent: Mar. 8, 1994

[54] CHILD-RESISTANT CLOSURE WITH EASY OPENING FEATURE

[75] Inventor: Richard F. Reifers, New Canaan, Conn.

[73] Assignee: Calmar Inc., City of Industry, Calif.

[21] Appl. No.: 9,235

[22] Filed: Jan. 26, 1993

[51] Int. Cl.[5] ..... B65D 55/02; B65D 41/18

[52] U.S. Cl. ..... 215/206; 215/223; 215/224; 215/305; 215/317

[58] Field of Search ..... 215/206, 223, 224, 230, 215/305, 317, 321; 220/306, 281

[56] References Cited

U.S. PATENT DOCUMENTS

| | | | |
|---|---|---|---|
| 3,298,415 | 1/1967 | Klygis | 215/321 X |
| 3,519,163 | 7/1970 | Bardell | 220/306 |
| 3,627,160 | 12/1992 | Horvath . | |
| 3,980,194 | 9/1976 | Costa | 215/223 |
| 4,071,156 | 1/1978 | Lowe | 215/224 |
| 4,087,016 | 5/1978 | Towns et al. | 215/211 |
| 4,375,859 | 3/1983 | Fillmore | 215/223 |
| 4,534,481 | 8/1985 | Summers et al. | 215/253 |
| 4,966,294 | 10/1990 | Mack et al. | 220/266 |

*Primary Examiner*—Allan N. Shoap
*Assistant Examiner*—Vanessa Caretto
*Attorney, Agent, or Firm*—Watson, Cole, Grindle & Watson

[57] ABSTRACT

A child resistant package includes a snap-on closure of rigid and stiff material on a container having a neck finish with an annular locking rib having at least one notch. The closure has a locking lug extending radially inwardly from its skirt in alignment in a fire position with the notch upon rotation of the closure to permit removal of the closure when in the fire position. A finger tab extends radially outwardly from the skirt in alignment with the locking lug, and the skirt has rib structure extending radially inwardly from the skirt circumferentially spaced from the locking lug. The locking rib and rib structure having coacting cams for resiliently expanding the skirt upon snap locking the closure to the neck finish and upon removal of the closure. The locking lug and the rib structure are interengaged with the locking rib upon snap locking and the rib structure becomes disengaged from the locking rib upon removal of the closure. The improvement comprises the provision of at least one non-frangible disruption in the skirt for permitting at least one segment of the skirt adjacent such disruption to flex from an initial unflexed position thereof radially outwardly and back to its initial position as the rib structure disengages from the locking rib upon the removal of the closure and as the rib structure engages the locking rib upon the snap locking of the closure to the neck finish.

26 Claims, 2 Drawing Sheets

CHILD-RESISTANT CLOSURE WITH EASY OPENING FEATURE

BACKGROUND OF THE INVENTION

This relates to a snap-on closure adapted for use with a container available as a child-resistant package. More particularly, the improved snap-on closure of the invention has a feature which retains the integrity of the seal and snap-on fitment with the container neck finish while rendering the closure easier to open in the unlocked position of the closure.

Child resistant snap closures are widely known and are of many different varieties. In its simpliest form, such as that disclosed in U.S. Pat. No. 3,627,160, the closure skirt has an inner locking lug adapted to be aligned upon closure rotation with a notch located in an annular locking rib on the neck finish of the container to permit closure removal. In such position, known as the "fire" position, the closure is effectively unlocked to facilitate its removal. The closure skirt likewise has a pair of circumferentially extending snap beads on its inner wall with the midpoint diametrically opposite the lug for snap locking engagement with the annular locking rib. The locking lug lies in the same plane as the locking beads to likewise snap fit beneath the locking rib when the cap is manually pressed down over the container neck.

The closure skirt has an outer finger tab in alignment with the locking lug to provide a bearing surface for the operator's thumb or finger in lifting off the closure when the thumb tab and locking lug are oriented into alignment with the notch in the annular locking rib. Indicia which may be in the form of a triangle serving as a pointer is normally provided on the container neck to indicate when the locking lug is accurately in registry with the notch or gap of the annular locking rib, referred to as the "fire" position.

The closure skirt is relatively stiff and rigid although sufficiently resilient such that it flexes radially outwardly upon closure removal as coacting cam surfaces between the snap beads and the locking rib permit the beads to ride upwardly over the major diameter portion of the locking rib in the process of disengaging the beads from the rib during closure removal in the fire position. The inherent hoop strength offered by the closure skirt limits its resilient expansion thereby rendering the closure oftentimes difficult to remove by especially elderly people or those having finger dexterity or strength problems because of the necessary force required particularly for the removal of small-sized snap-on closures from small-sized containers Because of their smaller size, such closures resist flexing to a greater extent compared to larger-sized closures, hence requiring a greater force to remove from its container.

Also, during closure removal, the locking lug impacts against the outer peripheral edge of the neck finish, despite the unobstructive passage of the locking lug through the notch in the annular locking rib. Since the locking lug is located at a spaced axial distance from the closure end wall, in the same plane as the snap beads so as to underlie the locking rib in the snapped-on position, the lug strikes the upper peripheral edge of the neck finish at the container opening as the closure is tilted upwardly while swinging an arc using the opposite side of the closure as a fulcrum. This impact against the neck finish peripheral edge offers some resistance in the process of closure removal as the lug rides upwardly over such edge. During this process the closure skirt at the finger tab elastically expands radially outwardly as limited by the inherent hoop strength of the skirt.

This resistance may be overcome by those having the strength and finger dexterity to remove the cap in the fire position without much difficulty, although it may present a problem for others.

SUMMARY OF THE INVENTION

It is therefore an object of the present invention to provide a child-resistant, snap-on closure for snap fitment with the neck finish of the container generally as aforedescribed but with an improved feature permitting easier cap removal without compromising the seal and snap fitment integrity of the closure on the container.

The improved snap-on closure according to the invention is simple and economical to produce and operate yet highly effective in avoiding the aforedescribed problems by rendering the snap closure easier to remove in the fire position while retaining its child-resistant capability.

In accordance with the invention the closure skirt is provided with at least one break or disruption permitting the skirt to resiliently flex radially outwardly beyond the limits of its inherent hoop strength as the snap beads ride upwardly over the major diameter portion of the locking rib in the process of closure removal at the fire position. The outward expansion or flexing of the skirt as facilitated by the break or disruption reduces the hoop tension thereby permitting the snap beads to more readily disengage from the annular locking rib.

A break or disruption may be provided at one or more desired locations in the closure skirt for relaxing the hoop strength to facilitate easier disengagement of the snap beads/locking rib. Locating the break(s) or disruption(s) at or adjacent the finger tab enables the skirt portion at the tab to flex radially outwardly as the locking lug impacts against the upper peripheral edge of the neck finish at the container opening during the process of closure removal a the fire position. Again, since the inherent hoop strength of the closure skirt is relaxed or reduced by the provision of the break(s) or disruption(s), the locking lug can more easily ride up over the upper peripheral edge of the container neck finish thereby contributing to the ease in closure removal.

Since the closure skirt is resilient the break(s) or disruption(s) in the skirt will not interfere with the ability of the closure skirt to tightly and securely snap fit with the annular locking rib on the neck finish, as before.

As will be described more fully hereinafter, more than one break or disruption in the closure skirt can be provided and different forms and shapes thereof are made possible in keeping with the invention.

Other objects, advantages and novel features of the invention will become more apparent from the following detailed description of the invention when taken in conjunction with the accompanying drawings.

DETAILED DESCRIPTION OF THE INVENTION

Figure 1:
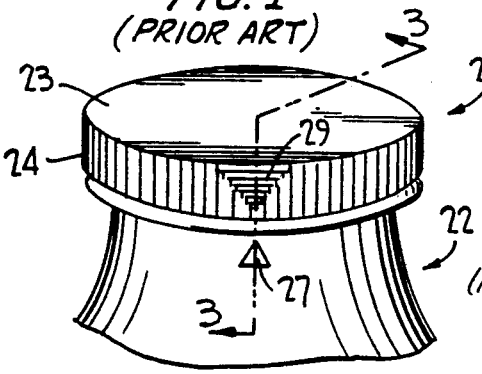
FIG. 1 (PRIOR ART)
FIG. 1 is perspective view of a prior art snap closure removably mounted on the neck finish of the container and shown in the fire position.
Figure 2:
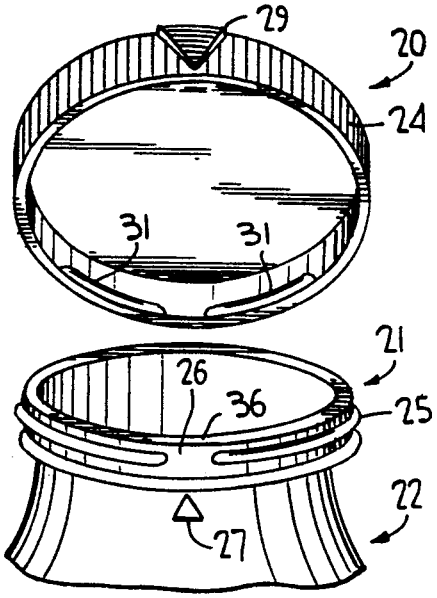
FIG. 2 (PRIOR ART)
FIG. 2 is a view similar to FIG. 1 but showing the closure completely removed.
Figure 3:
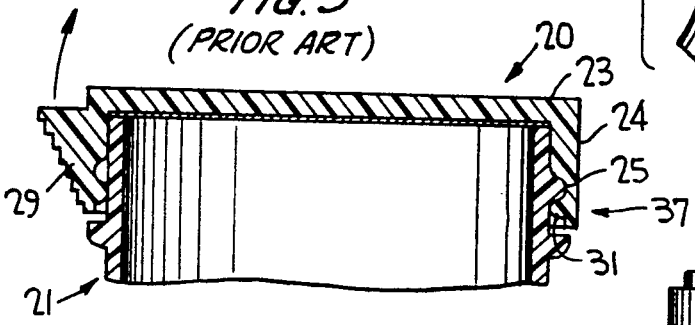
FIG. 3 (PRIOR ART)
FIG. 3 is a sectional view taken substantially along the line 3—3 of FIG. 1.
Figure 4:
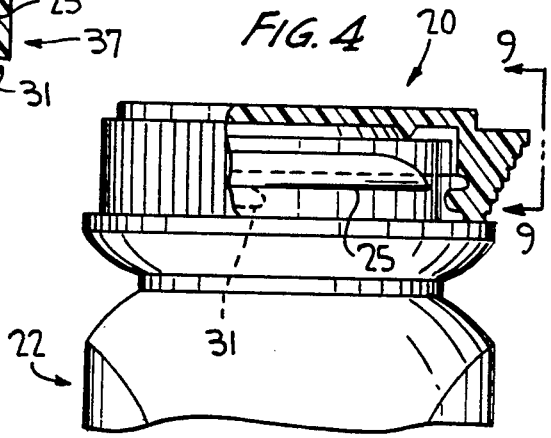
FIG. 4 is a side view, partly in section, of the improved snap closure of the invention shown snap fitted to the neck finish of the container.

Turning now to the drawings wherein like reference characters refer to like and corresponding parts throughout the several views, a prior art child resistant snap closure 20 is shown in FIGS. 1, 2 and 3 removably mounted to neck finish 21 of container 22. Both the closure and container may be of a molded high density polyethylene material or other appropriate plastic material, although the container could be formed of conventional glass material.

The closure has an end wall 23 and a peripheral annular skirt 24 generally of uniform cross-section.

The neck finish has a radially outwardly extending annular locking rib 25 with at least one notch 26 therein forming a gap, and triangular indicia 27 or the like on the neck finish in alignment with the notch.

Skirt 24 of the closure has a radially inwardly extending locking lug 28, and a radially outwardly extending finger tab 29 in alignment with the locking lug. The closure skirt likewise has radially inwardly extending rib structure which may be in the form of a pair of spaced snap beads 31 having a midsection diametrically opposite locking lug 28. The snap beads are circumferentially spaced from the locking lug and lie in substantially the same radial plane therewith.

The closure is snap fitted to the neck finish as locking lug 28 and snap beads 31 engage beneath locking rib 25 upon manual application of a downward force against end wall 23 with the closure in any rotative orientation relative to the container except for its orientation shown in FIGS. 1, 2 and 3 in which locking lug 28 is in alignment with notch 26. In this position, the snap beads alone engage beneath the locking rib for snap closing the closure in place.

And, in the rotative position of FIGS. 1, 2 and 3, with the finger tab aligned with indicia 27, the operator simply applies an upward force against the finger tab for urging lug 28 upwardly through notch 26 incident to removal of the closure.

The locking lug and/or snap beads as well as the locking rib are appropriately rounded to effect cooperative camming action as the cap is both snap fitted to the neck finish and as the closure is removed therefrom. The closure skirt resiliently expands upon flexing during the process of both snap fitting the closure in place and upon closure removal.

The cap skirt has an inherent hoop strength which limits resilient expansion and flexing of the skirt in a radially outwardly direction upon snap fitting the locking lug and snap beads to the locking rib and upon releasing the snap beads from the locking rib. This structural characteristic of the closure oftentimes renders it difficult to open and remove the closure by especially the elderly and/or those lacking finger dexterity and/or strength. Also, closures of a relatively small size are found difficult to open due to the added stiffness of the small sized closure.

Figure 6:
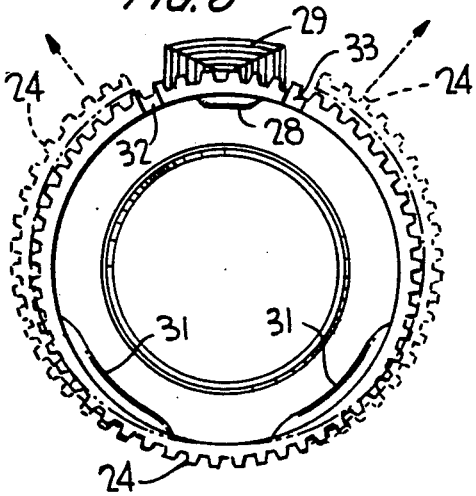
FIG. 6 is an underside plan view of the snap closure of FIG. 5 illustrating, in exaggerated form, the resilient flexing of the closure skirt upon disengagement of the snap beads and locking rib in the early process of closure removal.
Figure 7:
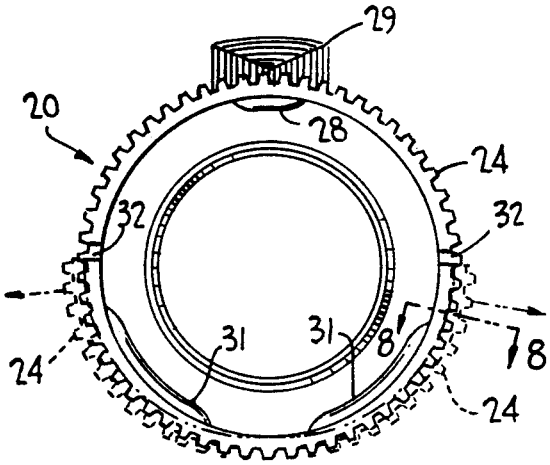
FIG. 7 is a view similar to FIG. 6 of another embodiment of the invention.
Figure 8:
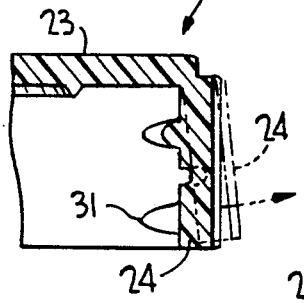
FIG. 8 is a sectional view taken substantially along the line 8—8 of FIG. 7.
Figure 9:
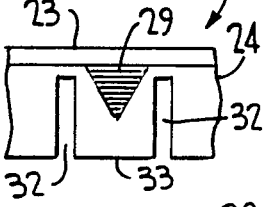
FIG. 9 is a front elevational view showing a portion of the closure skirt containing breaks or disruptions of one type according to the invention, taken substantially along the line 9—9 of FIG. 4.

According to the invention, the closure is rendered easier to open and to remove by the provision of at least one non-frangible break or disruption in closure skirt 24 for essentially relaxing the inherent hoop strength of the closure skirt permitting the skirt to flex from its initial position shown in solid outline in FIGS. 6, 7 and 8 radially outwardly to its phantom outline position shown in FIGS. 6, 7 and 8 upon releasing the snap beads from the locking rib as the beads cam outwardly to ride upwardly over the major diameter portion of the locking rib and back to its initial solid outline position as permitted by the inherent characteristics of the known plastic material employed for snap closure 20. The break or disruption may be in the form of a narrow slit or a slot 32 shown in FIG. 9 as extending from edge 33 of the skirt toward its end wall 23. The length of the slit or slot is optional, and more than one such slit or slot may be provided in the cap skirt as may be determined to reduce the inherent hoop strength of the cap skirt permitting the closure skirt to flex radially outwardly as shown in phantom outline and by the arrows in FIG. 6.

Figure 5:
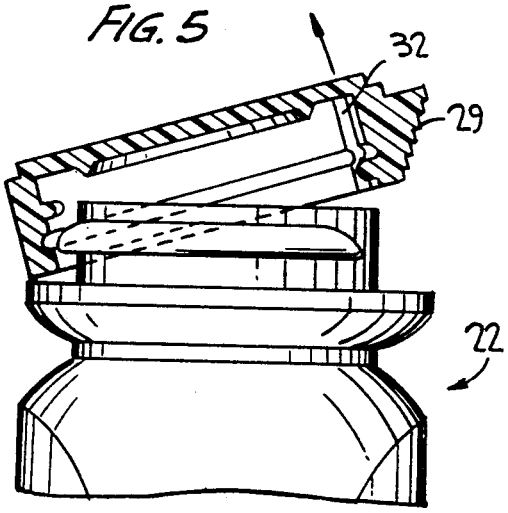
FIG. 5 is a view similar to view 4 showing the closure in the process of removal after the closure has been rotated to its fire position.

Thus, with locking lug 28 aligned with notch 26 in readiness for closure removal, i.e., in the fire position, finger tab 29 is manually pressed upwardly whereupon snap beads 31 disengage from locking rib 25 as the beads cam outwardly so as to ride upwardly over the major diameter portion of locking rib 25 as shown during closure removal in FIG. 5. During the process of snap bead disengagement, skirt 24 is caused to resiliently flex slightly in a radially outward direction shown in phantom outline in FIG. 6 assuming the provision of at least one slit or slot 32 in or at the vicinity of the finger tab. Only one such slit or slot is necessary, and that slit slot, or a pair thereof, may be located at any desired location in the closure skirt other than at or in the finger tab.

Figure 10:
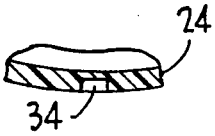
FIG. 10 is a sectional view taken substantially along the line 10—10 of FIG. 9A.
Figure 9A:
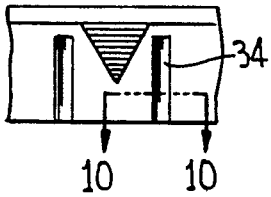
FIG. 9A a view similar to FIG. 9 showing breaks or disruptions in the closure skirt of another type.
Figure 10A:
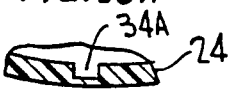
FIG. 10A is a view similar to FIG. 10 of another version of the breaks or disruptions thereof.
Figure 11:
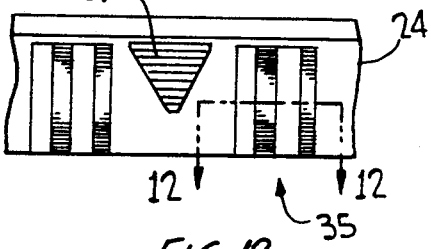
FIG. 11 is a view similar to FIG. 9 of yet another type break or disruption which may be located in the closure skirt according to the invention.
Figure 12:
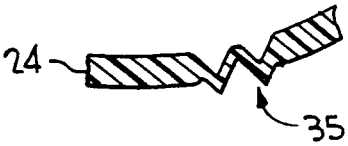
FIG. 12 is a cross-sectional view taken substantially along the line 12—12 of FIG. 11.

As shown in FIGS. 9A, 10 and 10A, the disruption may be alternately in the form of a reduced wall thickness 34 opening outwardly (FIG. 10) or inwardly (FIG. 10A) of the closure. Otherwise, the disruption may be in the form of a corrugated or crimped section 35 of the cap skirt, as shown in FIGS. 11 and 12. Other forms or locations of breaks or disruptions may likewise be provided without departing from the invention.

For example, locating the breaks or disruptions, such as slots 32 shown in FIG. 7, closer to the snap beads, enables the cap skirt to flex radially outwardly in the process of closure removal as in the manner shown in phantom outline in FIGS. 7 and 8.

The conventional child-resistant snap closure package presents another problem which oftentimes renders it difficult for some operators to remove the closure. For example, in the process of removing the prior art closure from its FIG. 1 position to that of FIG. 2, locking lug 28 impacts against upper peripheral edge 36 of the neck finish (FIG. 2) while the diametrically opposite side of the closure, as at 37, acts as a fulcrum. Lug 28 and its closure skirt cam outwardly as the lug rides upwardly over peripheral edge 36. The closure skirt flexes resiliently outwardly during this process, as limited by the inherent hoop strength of the skirt.

Figure 13:
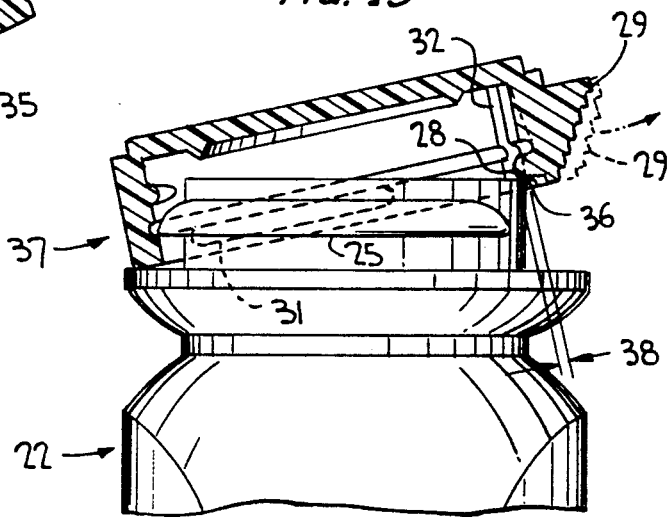
FIG. 13 is a view similar to FIG. 5, at an enlarged scale, illustrating the outward flexing of the closure skirt at the finger tab in response to impact between the locking lug and the upper peripheral edge of the neck finish.

In accordance with the invention, by locating a non-frangible break or disruption, such as a slot or a slit 32, adjacent one or both sides of finger tab 29, the closure skirt at the finger tab is permitted to flex from its solid outline position of FIG. 13 radially outwardly to its phantom outline in FIG. 13 in the direction of the arrow shown. As lug 28 impacts against edge 36 in the process of closure opening shown in FIG. 13, the interference between lug 28 and edge 36 (shown at 38) is overcome by the provision of the non-frangible break(s) or disruption(s) as aforedescribed to thereby enable easier opening of the closure after which the closure skirt at the finger tab returns to its solid outline position as permitted by the inherent characteristics of the known plastic material employed for the snap closure. Of course, any of the breaks or disruptions described above or equivalent thereto can be provided without departing from the invention.

From the foregoing, it can be seen that a simple yet highly effective improvement for a child resistant snap closure has been provided which permits a segment or segments of the closure skirt to flex resiliently outwardly during closure removal to facilitate easier opening. Yet, in the snap-fitted condition of the closure, the snap beads and locking lug tightly and positively interengage with the annular locking rib on the neck finish for locking and sealing the closure in place.

Obviously, many other modifications and variations of the present invention are made possible in the light of the above teachings. It is therefore to be understood that within the scope of the appended claims the invention may be practiced otherwise than as specifically described.

What is claimed:

1. A child resistant package including a snap-on closure of rigid and stiff material, comprising a container having a neck finish including an annular locking rib with at least one notch therein, the closure, being disposed for rotary movement on the neck finish, having an end wall and a resilient peripheral skirt, a locking lug extending radially inwardly from said skirt in alignment in a fire position with said notch upon rotation of the closure to permit removal of said closure only when in the fire position, a finger tab extending radially outwardly from said skirt in alignment with said locking lug, said skirt having rib structure adjacent the lower peripheral edge thereof, said rib structure extending radially inwardly from said skirt and having a midsection diametrically opposite said locking lug, said rib structure being circumferentially spaced from said locking lug, said locking rib and said rib structure having coacting cam means for resiliently expanding said skirt and its rib structure upon snap locking the closure to the neck finish and upon removal of said closure, said locking lug and said rib structure being interengaged with said locking rib upon snap locking and said rib structure becoming disengaged from said locking rib upon the removal of said closure, the improvement wherein said skirt has at least one non-frangible disruption for permitting the lower peripheral edge of at least one segment of said skirt adjacent said one disruption to flex from an initial unflexed position thereof radially outwardly and back to the initial position as said rib structure disengages from said locking rib upon the removal of said closure and as said rib structure engages said locking rib upon the snap locking of the closure to the neck finish.

2. The child-resistant package according to claim 1, wherein said skirt has a pair of spaced non-frangible disruptions for permitting the lower peripheral edge of a pair of segments of said skirt adjacent said disruptions to flex radially outwardly from the initial position and back to the initial position as said rib structure disengages from said locking rib upon the removal of said closure and as said rib structure engages said locking rib upon the snap locking of the closure to the neck finish.

3. The child-resistant package according to claim 1, wherein said disruption comprises a slot extending from the lower peripheral edge of said skirt toward said end wall.

4. The child-resistant package according to claim 2, wherein each said disruption comprises a slot extending from the lower peripheral edge of said skirt toward said end wall.

5. The child-resistant package according to claim 1, wherein said skirt has a section of reduced wall thickness comprising said disruption.

6. The child-resistant package according to claim 2, wherein said skirt has spaced sections of reduced wall thickness comprising said disruptions.

7. The child-resistant package according to claim 1, wherein said disruption is located adjacent said finger tab.

8. The child-resistant package according to claim 2, wherein said disruptions are respectively located on opposite sides of said finger tab.

9. The child-resistant package according to claim 1, wherein said disruption is located between said finger tab and said rib structure.

10. The child-resistant package according to claim 2, wherein said disruptions are respectively located between said finger tab and said rib structure.

11. The child-resistant snap-on closure of rigid and stiff material for use with a container having a neck finish which includes as annular locking rib with at least one notch therein, said closure, being disposed for rotary movement on the neck finish, having an end wall and a resilient peripheral skirt, a locking lug extending radially inwardly from said skirt in alignment in a fire position with the locking rib notch in the locking rib upon rotation of the closure to permit removal of the closure only when in the fire position, a finger tab extending radially outwardly from said skirt in alignment with said locking lug, said skirt adjacent the lower peripheral edge thereof having a pair of snap beads extending radially inwardly from said skirt and having a midsection diametrically opposite said locking lug, said beads being circumferentially spaced from said locking lug, said skirt having an inherent hoop strength which limits resilient expansion of said skirt in a radially outward direction upon snap fitting said locking lug and said snap beads to the locking rib and upon releasing said snap beads from the locking rib during removal of the closure when rotated into the fire position, the improvement wherein said skirt has at least one non-frangible disruption for relaxing the inherent hoop strength to permit at least one segment of said skirt adjacent said disruption to flex from an initial unflexed position thereof radially outwardly and back to the initial position upon releasing said snap beads from said locking rib and upon the snap fitting of said locking lug and said snap beads to the locking rib.

12. The closure according to claim 11, wherein said skirt has a pair of spaced non-frangible disruptions for reducing the inherent hoop strength to permit a pair of segments of said skirt adjacent said disruptions to flex radially outwardly upon releasing said snap beads from the locking rib and upon the snap fitting of said locking lug and said snap beads to the locking rib.

13. The closure according to claim 11, wherein said disruption comprises a slit extending from the lower peripheral edge of said skirt toward said end wall.

14. The closure according to claim 12, wherein each said disruption comprises a slit extending from the lower peripheral edge of said skirt toward said end wall.

15. The closure according to claim 11, wherein said disruption comprises a reduced wall thickness section in said skirt.

16. The closure according to claim 12, wherein each disruption comprises a reduced wall thickness section in said skirt.

17. The closure according to claim 11, wherein said disruption comprises a crimped section in said skirt.

18. The closure according to claim 12, wherein each said disruption comprises a crimped section in said skirt.

19. A child resistant package including a snap-on closure of rigid and stiff material, comprising a container having a neck finish including an annular locking rib with at least one notch therein, the closure, being disposed for rotary movement on the neck finish, having an end wall and a resilient peripheral skirt, a locking lug extending radially inwardly from said skirt in alignment in a fire position with said notch upon rotation of the closure to permit removal of said closure only when in the fire position, a finger tab extending radially outwardly from said skirt in alignment with said locking lug, said skirt having rib structure adjacent the lower peripheral edge thereof, said rib structure extending radially inwardly from said skirt and having a midsection diametrically opposite said locking lug, said rib structure being circumferentially spaced from said locking lug, said locking rib and said rib structure having coacting cam means for resiliently expanding said skirt and its rib structure upon snap locking the closure to the neck finish and upon removal of said closure, said locking lug being spaced from said end wall and being substantially in contact with an outer surface of the neck finish upon interengagement in the fire position of said rib structure with said locking rib whereby upon the closure removal and upon the snap locking of the closure said locking lug impacts against an outer peripheral edge of the neck finish, the improvement wherein said skirt has at least one non-frangible disruption adjacent said finger tap to permit a segment of said skirt at said tab to flex from an initial unflexed position thereof radially outwardly and back to the initial position upon the impact of said lug against the outer peripheral edge of the neck finish during the removal of the closure and during the snap locking of the closure to the neck finish.

20. The closure according to claim 19, wherein said skirt has a pair of disruptions located on opposite adjacent sides of said finger tab.

21. The closure according to claim 19, wherein said disruption is in the form of a slit extending from the lower peripheral edge of said skirt toward said end wall.

22. The closure according to claim 20, wherein each said disruption is in the form of a slit extending from the lower peripheral edge of said skirt toward said end wall.

23. The closure according to claim 19, wherein said disruption is in the form of a reduced skirt wall thickness.

24. The closure according to claim 20, wherein each said disruption is in the form of a reduced skirt wall thickness.

25. The closure according to claim 19, wherein said disruption is in the form of a corrugated section of the skirt.

26. The closure according to claim 20, wherein each said disruption is in the form of a corrugated section of the skirt.

* * * * *